US010349805B2

(12) United States Patent
Blanchard et al.

(10) Patent No.: US 10,349,805 B2
(45) Date of Patent: Jul. 16, 2019

(54) DISHWASHER WITH RACK CORNER SPRAY SYSTEM

(71) Applicant: Whirlpool Corporation, Benton Harbor, MI (US)

(72) Inventors: Walter T. Blanchard, Georgetown, TX (US); David H. Chen, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 32 days.

(21) Appl. No.: 15/593,553

(22) Filed: May 12, 2017

(65) Prior Publication Data

US 2017/0245727 A1 Aug. 31, 2017

Related U.S. Application Data

(63) Continuation of application No. 14/338,610, filed on Jul. 23, 2014, now Pat. No. 9,668,635, which is a continuation of application No. 13/105,075, filed on May 11, 2011, now Pat. No. 8,801,863.

(51) Int. Cl.

| | |
|---|---|
| ***A47L 15/16*** | (2006.01) |
| ***A47L 15/22*** | (2006.01) |
| ***A47L 15/42*** | (2006.01) |
| ***A47L 15/50*** | (2006.01) |

(52) U.S. Cl.

CPC ..... *A47L 15/16* (2013.01); *A47L 15/22* (2013.01); *A47L 15/4219* (2013.01); *A47L 15/4221* (2013.01); *A47L 15/4278* (2013.01); *A47L 15/4285* (2013.01); *A47L 15/504* (2013.01); *A47L 15/507* (2013.01); *A47L 15/508* (2013.01)

(58) Field of Classification Search

CPC ..... A47L 15/16; A47L 15/22; A47L 15/4219; A47L 15/4278

See application file for complete search history.

(56) References Cited

U.S. PATENT DOCUMENTS

| | | | | |
|---|---|---|---|---|
| 2,977,963 | A | 4/1961 | Klint | |
| 3,463,173 | A | 8/1969 | Goldman | |
| 3,960,328 | A | 6/1976 | Archambault | |
| 5,823,211 | A | 10/1998 | Wilhelmstatter et al. | |
| 6,325,083 | B1 * | 12/2001 | Worter | A47L 15/23 134/176 |
| 6,431,188 | B1 | 8/2002 | Laszczewski, Jr. et al. | |
| 6,869,029 | B2 | 3/2005 | Ochoa, Sr. et al. | |
| 7,055,537 | B2 | 6/2006 | Elick et al. | |
| 7,146,992 | B2 | 12/2006 | Elick et al. | |
| 7,210,489 | B2 | 5/2007 | Eiermann | |
| 7,410,228 | B2 | 8/2008 | Dickson et al. | |

(Continued)

FOREIGN PATENT DOCUMENTS

| | | |
|---|---|---|
| EP | 0796587 | 5/1999 |
| EP | 0862891 | 12/2003 |

(Continued)

*Primary Examiner* — Mikhail Kornakov
*Assistant Examiner* — Natasha N Campbell
(74) *Attorney, Agent, or Firm* — Diederiks & Whitelaw, PLC.

(57) ABSTRACT

A dishwasher includes a rack provided with interior and exterior corner nozzles to direct washing fluid onto interior and exterior surface portions of an object placed in a corner of the rack.

20 Claims, 7 Drawing Sheets

(56) References Cited

U.S. PATENT DOCUMENTS

| | | | |
|---|---|---|---|
| 7,754,024 | B2 | 7/2010 | Koch et al. |
| 7,914,625 | B2 | 3/2011 | Bertsch et al. |
| 2003/0192578 | A1 | 10/2003 | Ochoa, Sr. et al. |
| 2007/0235063 | A1 | 10/2007 | Lee et al. |
| 2009/0159103 | A1 | 6/2009 | Gillum |
| 2010/0116296 | A1 | 5/2010 | Bertsch et al. |
| 2010/0139719 | A1 | 6/2010 | Gnadinger et al. |
| 2011/0030742 | A1 | 2/2011 | Dalsing |

FOREIGN PATENT DOCUMENTS

| | | |
|---|---|---|
| EP | 1935322 | 6/2008 |
| WO | 2009027370 | 3/2009 |
| WO | 2009027415 | 3/2009 |

* cited by examiner

DISHWASHER WITH RACK CORNER SPRAY SYSTEM

CROSS-REFERENCE TO RELATED APPLICATIONS

This application represents a continuation of U.S. patent application Ser. No. 14/338,610, filed Jul. 23, 2014, entitled "Dishwasher with Rack Corner Spray System", now U.S. Pat. No. 9,668,635, which is continuation of U.S. patent application Ser. No. 13/105,075, filed May 11, 2011 entitled "Dishwasher with Rack Corner Spray System", now U.S. Pat. No. 8,801,863.

BACKGROUND OF THE INVENTION

Field of the Invention

The present invention pertains to the art of dishwashers and, more particularly, to a dishwasher including a rack and a system for delivering a concentrated flow of washing fluid to at least a corner portion of the rack.

Description of the Related Art

In the art of dishwashers, it is known to provide multiple, vertically spaced spray arms within a single wash tub in order to enhance the spray patterns of washing fluid. For use with these various spray arm arrangements, many different types of fluid distribution systems have been developed to address different problems or to provide a dishwasher with specific functionality. By way of example, it is known in the art to provide a dishwasher tub with a lower, rotatable spray arm mounted for rotation below a lower rack, an upper, rotatable spray arm mounted above an upper rack and an intermediate, rotatable spray arm provided below the upper rack. In such an arrangement, the intermediate spray arm is mounted to the upper rack for concurrent movement into and out of the tub of the dishwasher. To accommodate this movement, a fluid connection must be made to the intermediate spray arm upon retraction of the upper rack into the tub.

If the upper rack is vertically adjustable, additional provisions must be made to provide the necessary fluid connection when the upper rack is in each of the various vertical orientations. In general, this adjustability function is accomplished by fixedly mounting a valve and manifold assembly to the tub at the height of the upper rack, with the manifold including multiple ports which can be alternatively accessed to provide the requisite washing fluid flow to the intermediate spray arm.

As an additional consideration, it can be desirable to provide a flow control system to regulate the flow timing to each of the spray arms. For instance, based on water pressure or other reasons, it may not be feasible to provide flow to each of the spray arms simultaneously. If this is the case, separate and distinct fluid conduits and/or complicated valving may be employed in combination with a water diverter mechanism in order to selectively direct the washing fluid to the lower wash arm, the upper wash arm, the intermediate wash arm or certain combinations of the wash arms.

Simply stated, regardless of these known systems, there is still seen to exist a need to further modify the parameters and configuration of an overall washing system within a dishwasher to provide a spray flow and coverage that will enhance the overall cleaning operation being performed.

SUMMARY OF THE INVENTION

The present invention provides for an enhanced dishwasher washing system including a rack supporting multiple, distinct spray arms. That is, the dishwasher includes a rack carrying multiple, distinct washing fluid spray arms, with one of the spray arms functioning to concentrate the spray of washing fluid directly in a corner region of the rack. In a preferred embodiment, the rack constitutes an upper rack for the dishwasher and the spray arms include a rotatable spray arm suspended beneath the upper rack and a bifurcated spray arm unit which establishes front spray arms, side spray arms or a combination of front and side spray arms. A fluid distribution system, including a multi-tube feed arrangement in combination with a rack supported manifold, is employed to provide for selective distribution of washing fluid to the rack spray arms. Associated with the front and/or side spray arms are corner nozzles. More specifically, a corner of the rack is provided with both an interior corner nozzle and an exterior corner nozzle.

During operation of the dishwasher, a diverter valve mechanism is employed to selectively deliver washing fluid from a recirculation pump assembly to the various spray arms of the dishwasher. In connection with the upper rack, the diverter valve mechanism directs washing fluid to a select one of the feed tubes, with one feed tube directing washing fluid through the manifold to the rotatable spray arm and another feed tube directing washing fluid through the manifold to the corner region. The manifold is internally divided to establish a split chamber and includes multiple ports to maintain separate the fluid flow from the recirculation pump assembly to the distinct spray arms. In a preferred embodiment, the manifold actually includes upper and lower sets of ports to also accommodate vertical adjustment of the upper rack, while still providing for the separate flow patterns. Distribution control is based on both washing cycle selections and cycle timing. In particular, with this arrangement, a glass or other container can be placed over the interior nozzle during operation of the dishwasher and, during predetermined portions of the washing cycle, fluid is directed to both the interior and exterior nozzles in order to thoroughly cleanse inside surface portions of the glass or container, as well as assure that an outer corner exposed surface portions of the glass or container is adequately sprayed.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
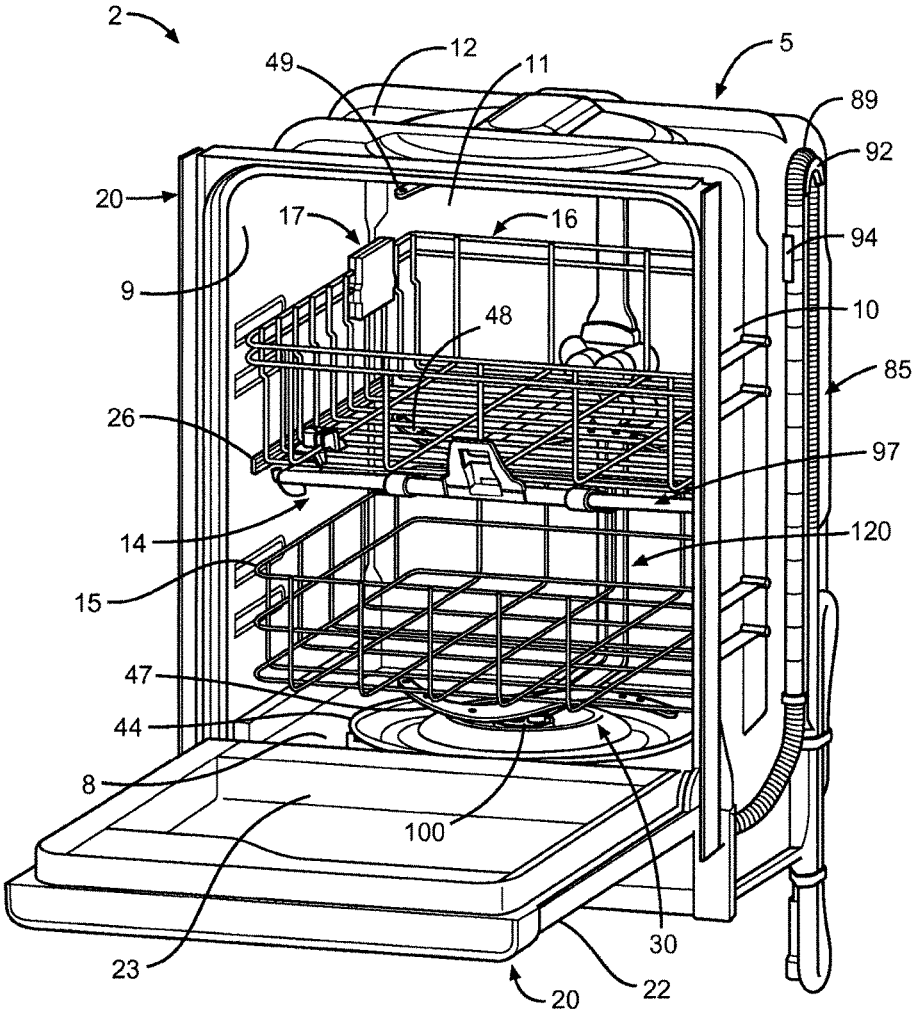
FIG. 1 is a perspective view of a dishwasher incorporating a rack corner spray system constructed in accordance with the present invention.

With initial reference to FIG. 1, a dishwasher constructed in accordance with the present invention is generally indicated at 2. As shown, dishwasher 2 includes a tub 5, which is preferably injection molded of plastic, so as to include integral bottom, side, rear and top walls 8-12 respectively. Within the confines of walls 8-12, tub 5 defines a washing chamber 14 within which soiled kitchenware is adapted to be placed on a lower dish rack 15 and/or an adjustable upper rack 16 which is mounted through an adjustment mechanism 17 for vertically shifting dish rack 16 between a first or lowered position and a second or raised position. As the particulars of adjustment mechanism 17 do not form part of the invention, they will not be described further here. Instead, an adjustment mechanism known in the art can be employed, such as that disclosed in U.S. Pat. No. 7,410,228 incorporated herein by reference. As shown in this figure, tub 5 pivotally supports a door 20, having an exterior panel 22 and an interior panel 23, used to seal washing chamber 14 during a washing operation.

In a manner known in the art, upper rack 16 is horizontally shiftable between a first, retracted position wherein upper rack 16 is entirely within the confines of washing chamber 14 as shown in FIG. 1 and a second, extended position, wherein upper dish rack 16 projects, at least partially outward, from washing chamber 14. Toward that end, dishwasher 2 is provided with extensible support members, one of which is indicated generally at 26. In a similar manner, lower dish rack 15 is selectively, horizontally shiftable between retracted and extended positions. However, when in the extended position, lower dish rack 15 rests upon an open door 20 on guide elements (not separately labeled) formed on interior panel 23.

Disposed within tub 5 and, more specifically, mounted within a central opening formed in bottom wall 8 of tub 5, is a pump assembly 30 constructed in a manner known in the art, such as that represented by U.S. Pat. No. 7,146,992 which is incorporated herein by reference. Extending about a substantial portion of pump assembly 30, at a position raised above bottom wall 8, is a heating element 44. In a manner known in the art, heating element 44 preferably takes the form of a sheathed, electric resistance-type heating element. In general, pump assembly 30 is adapted to direct washing fluid to a lower spray arm 47, an intermediate spray arm 48 and an upper arm 49 as will be detailed fully below.

For the sake of completeness, dishwasher 2 also has associated therewith a drain hose 85 including at least one corrugated or otherwise curved portion 89 that extends about an arcuate hanger 92 provided on an outside surface of side wall 10. Drain hose 85 is also preferably secured to tub 5 through various clips, such as that indicated at 94. In this manner, an upper loop is maintained in drain hose 85 to assure proper drainage in a manner known in the art. As the exact structure and operation of pump assembly 30 of dishwasher 2 is not part of the present invention, it will not be discussed further herein. Instead, the present invention is directed to particulars of the washing system associated with upper rack 16. More specifically, the invention is concerned with the manner in which washing fluid is delivered from pump assembly 30 to at least corner spray units carried by rack 16 as will be detailed below.

Figure 2:
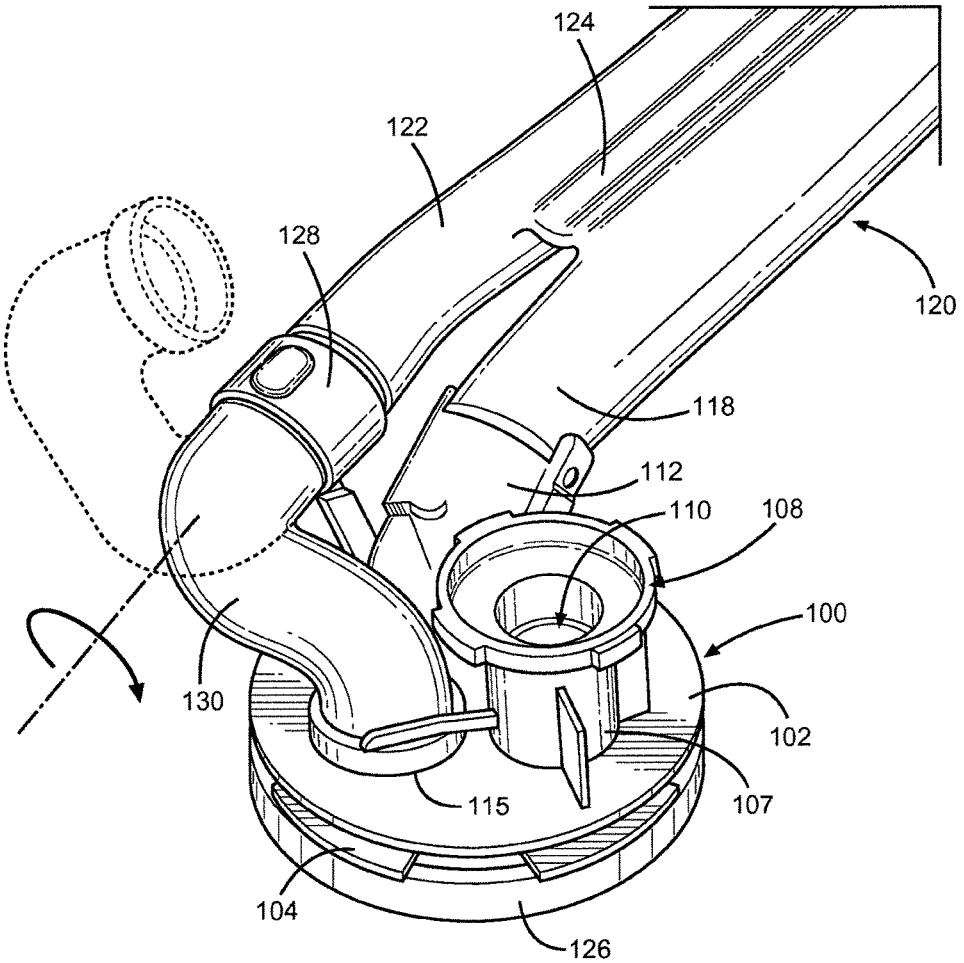
FIG. 2 is a perspective view of feed tube connections to a distribution cap of a recirculation pump assembly of the dishwasher of FIG. 1.

In connection with the flow of washing fluid, FIG. 2 depicts an enlarged view of a distribution head 100 provided atop pump assembly 30. As shown, distribution head 100 includes a plate 102 beneath which are provided a plurality of circumferentially spaced fins, one of which is indicated at 104. Fins 104 are configured to be aligned with cut-outs (not shown) provided in pump assembly 30 and enable distribution head 100 to be mounted atop pump assembly 30 through a twist lock arrangement. More importantly, distribution head 100 is shown to include a first outlet 107 having a head portion 108 to which spray arm 47 is adapted to be rotatably mounted in a manner known in the art. Head portion 108 defines a flow passage 110 for directing a flow of washing fluid generated by pump assembly 30 to spray arm 47.

Distribution head 100 also has associated therewith a second outlet 112 and a third outlet 115. A first tube 118 of a multi-tube feed arrangement generally indicated at 120 is attached to second outlet 112 and is also adapted to receive a flow of washing fluid from pump assembly 30. Multi-tube feed arrangement 120 also includes a second tube 122 that is shown to be interconnected to first tube 118 through a web 124. Preferably, first and second tubes 118 and 122 are formed together to establish a unitary conduit assembly even though first tube 118 and second tube 122 are completely separate and distinct with respect to their isolated fluid flows. Mounted to an end of second tube 122 is a connector 128 that is part of a rotatable leg 130 which fluidly interconnects second tube 122 to third outlet 115 of distribution head 100.

During overall assembly, multi-tube feed arrangement 120 is connected to distribution head 100 with first tube 118 being initially connected to second outlet 112 and then leg 130 is rotated in order to register with third outlet 115. In any case, at this point, it should be recognized that distribution head 100 provides for three distinct flows there through in connection with first, second and third outlets 107, 112 and 115. As will be detailed more fully below, the flow to each of first, second and third outlets 107, 112 and 115 is regulated during a washing operation such that the flows are not simultaneously provided in order to enhance flow pressure. In connection with regulating these various flows, a diverter valve unit, generally indicated at 126, is provided beneath distribution head 100 and incorporated into pump assembly 30. In general, the function and operation of a diverter valve unit in the dishwasher art is known as evidenced by the disclosure in U.S. Pat. No. 7,914,625, incorporated herein by reference. Therefore, as the specific details of the operation of diverter valve unit 126 is not considered part of the present invention such that it will not be further discussed herein.

Figure 3:
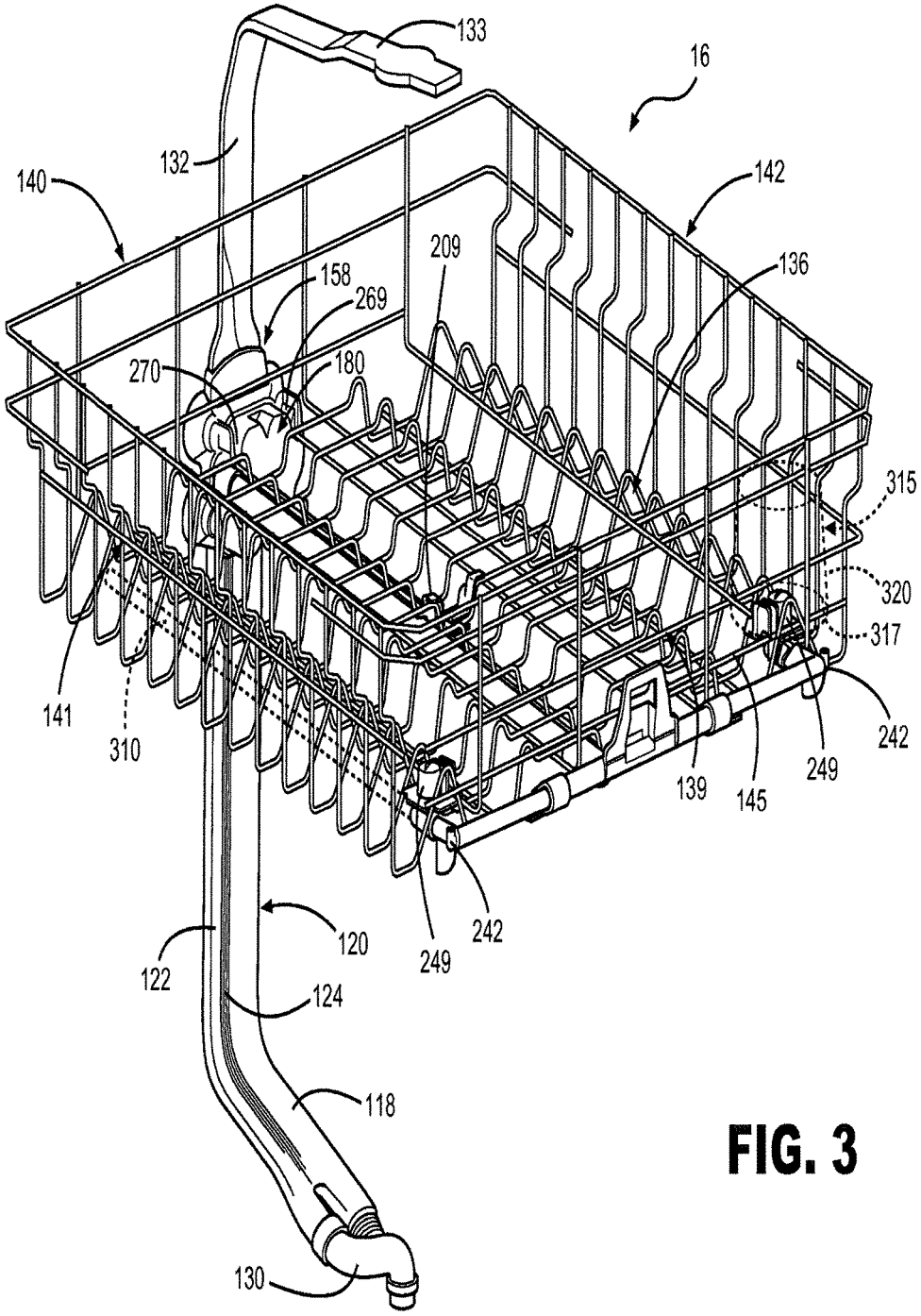
FIG. 3 is a perspective view of an upper rack of the dishwasher of FIG. 1 in combination with a fluid distribution system, including a rack supported manifold for distributing washing fluid from the multi-feed tubes of FIG. 2 to multiple spray arms carried by the rack.

With reference to FIGS. 1 and 3, multi-tube feed arrangement 120 leads away from pump assembly 30 towards rear wall 11 of tub 5 and extends up rear wall 11. Above upper rack 16, second tube 122 terminates and first tube 118 of multi-tube feed arrangement 120 transitions into an upright tube extension 132 and a horizontal tube extension 133 which project above upper rack 16. Rotatably attached to horizontal tube extension 133 is upper spray arm 49. As best shown in FIG. 3, upper rack 16 includes a base 136, a front wall portion 139, rear wall portion 140 and side wall portions 141 and 142. In the embodiment shown, upper rack 16 is formed from a plurality of interconnected, plastic coated wires, one of which is indicated at 145 to be part of front wall portion 139. At this point, it should be realized that the actual layout of wires 145 for upper rack 16 can greatly vary in accordance with the present invention and such types of wire racks are widely known in the art.

Figure 4:
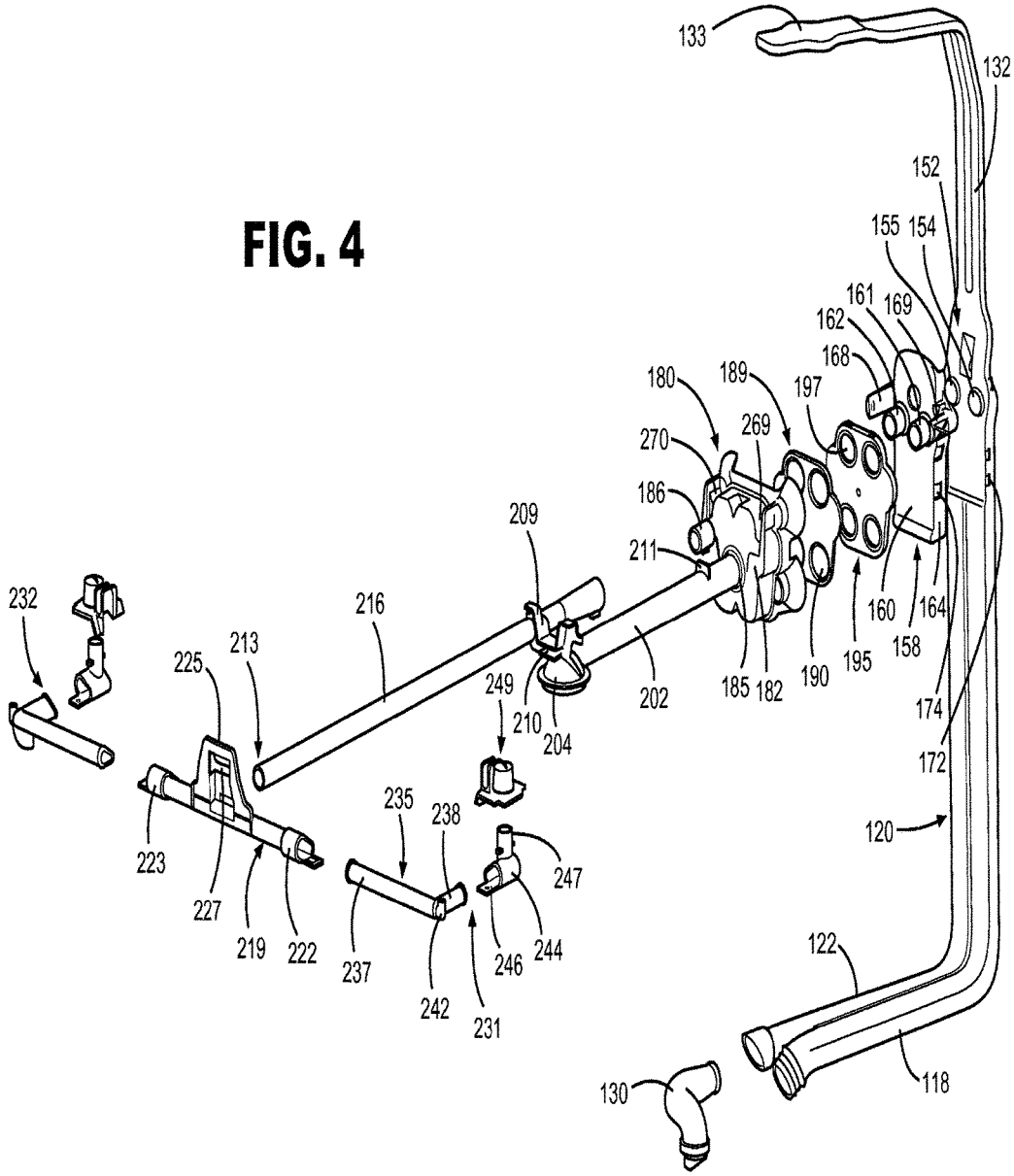
FIG. 4 is an exploded view of fluid distribution system and multiple spray arms of FIG. 3.
Figure 5:
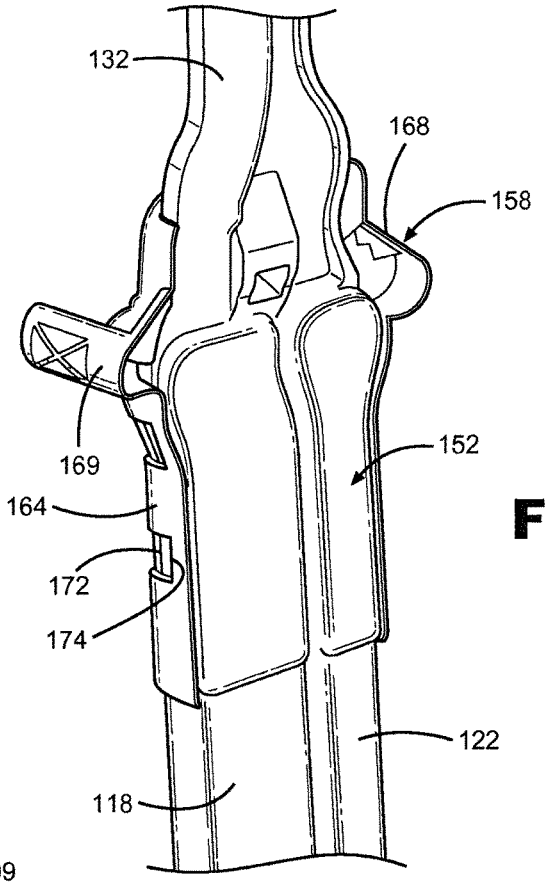
FIG. 5 is a rear view of a section of the multi-feed tubes having a manifold connection bracket attached thereto.

As shown in each of FIGS. 3-5, first tube 118 and second tube 122 lead to upright tube extension 132 through a junction 152. Junction 152 is provided with a pair of ports 154 and 155 (see FIG. 4) which open up to first tube 118 and second tube 122 respectively. Secured at junction 152 is a coupling 158 having a front plate 160 from which project port extensions 161 and 162. Coupling 158 also includes side plate portions, one of which is indicated at 164, as well as a pair of spaced ears or guide pins 168 and 169. In connection with securing coupling 158 to junction 152, multi-tube feed arrangement 120 is preferably formed with a plurality of vertically spaced, side locking tabs, one of which is indicated at 172, with tabs 172 aligning with respective openings 174 provided in side plate portions 164 of coupling 158. In this manner, coupling 158 can be snap-connected about junction 152, with tabs 172 extending into openings 174 (see FIG. 5). This locking arrangement, in combination with the manner in which coupling 158 conforms to the shape of junction 152, retains coupling 158 on junction 152, with port extensions 161 and 162 being aligned with ports 154 and 155 respectively.

Mounted to upper rack 16 for movement between the retracted and extended positions relative to tub 5 is a manifold 180. As shown best in FIG. 4, manifold 180 includes a body 182 provided with frontal ports 185 and 186. Interposed between body 182 of manifold 180 and coupling 158 is a flapper valve member 189. Basically, flapper valve member 189 is received within body 182 of manifold 180 and includes a plurality of flapper valves, one of which is indicated at 190. In general, flapper valve member 189 constitutes a flexible rubber sheet with flapper valves 190 being defined by portions of the flexible material which have been cut around its circumference except for along a short segment which enables the valve to be biased closed, yet move into body 182 of manifold 180 when engaged by a respective port extension 161, 162 as will become more fully evident below. To retain flapper valve member 189 in place within body 182, a cover member 195 is provided. Cover member 195 is preferably constituted by a hard plastic piece having a plurality of openings, one of which is indicated at 197, with openings 197 being aligned with flapper valves 190.

Extending from port 186 of manifold 180 is a first upper spray arm 202. At a terminal end (not labeled) of first upper spray arm 202 is arranged a head 204 to which is rotatably attached intermediate spray arm 48. Head 204 is also provided with an associated mounted bracket 209. As will be discussed more fully below, mounting bracket 209 is utilized in connection with attaching manifold 180 to upper rack 16 for concurrent movement. For this purpose, mounting bracket 209 includes a frontal slot 210 defined between upper and lower flanges (not labeled) and first upper spray arm 202 is provided with an upstanding locator flange 211 as also discussed further below. Also extending from body 182 of manifold 180 is a second spray arm generally indicated at 213. More specifically, in the embodiment shown, second spray arm 213 is formed from multiple, interconnected pieces and includes a flow tube 216 that extends about and is coupled to port 185 of manifold 180 and leads to a T-connector 219. With this arrangement, the flow in flow tube 216 is bifurcated so as to flow in opposing directions towards tubular ends 222 and 223 of T-connector 219. T-connector 219 is also formed with a mounting bracket 225 including a hanger element 227. Designed to be fluidly connected to tubular ends 222 and 223 are a pair of sub-arm assemblies 231 and 232. As each sub-arm assembly 231, 232 is identically constructed, details will now be made of sub-arm assembly 231 and it is to be understood that sub-arm assembly 232 has corresponding structure. As clearly shown in FIG. 4, sub-arm assembly 231 includes an angled flow tube 235 having a first leg 237 and a second leg 238. Given the generally rectangular configuration of upper rack 16, first leg 237 and second leg 238 are generally arranged perpendicular to one another. Certainly, other configurations are possible in order to conform to a desired shape of upper rack 16 and to enhance fluid flow. As also shown in these figures, an exterior corner nozzle 242 is provided at the junction between first leg 237 and second leg 238. Additional details of exterior corner nozzle 242 will be presented further herein. Sub-arm assembly 231 also includes a transition tube 244 having a first end 246 which is connected to second leg 238 and a second end 247 which is angled relative to first end 246 and preferably redirects washing fluid upward. Second end 247 has mounted thereto an interior corner nozzle 249 which will also be detailed further below.

Figure 6:
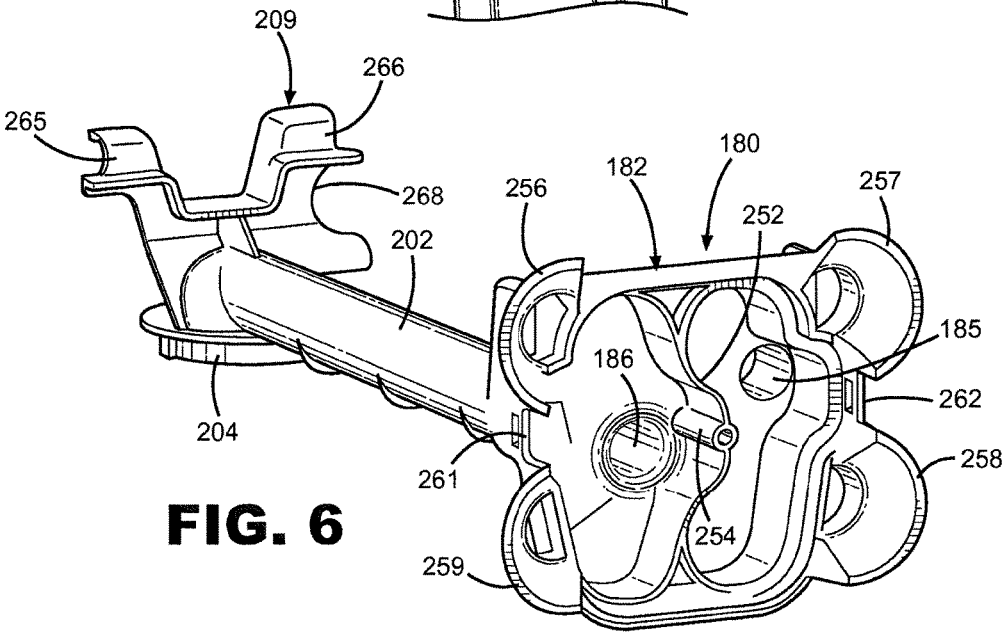
FIG. 6 is a rear perspective view of the manifold and an associated supply tube.

Reference will now be made to FIG. 6 in describing additional structural details of manifold 180, first upper spray arm 202 and mounting bracket 209. As shown, a rear portion of body 182 includes an internal divider 252 having a central boss 254 for the mounting of cover member 195. Body 182 is also provided with a series of lobes 256-259, as well as side regions 261 and 262 which are substantially flat and are defined by spaces between lobes 256 and 259 and lobes 257 and 258 respectively. At mounting bracket 209, which is spaced from body 182 of manifold 180 by first upper spray arm 202, is provided with a pair of spaced, upper support members 265 and 266. Each of support members 265 and 266 is adapted to engage a respective wire of upper rack 14 in connection with mounting manifold 180 and first upper spray arm 202 to upper rack 16. Below support member 266, mounting bracket 209 includes a concave portion 268 which receives flow tube 216 of second spray arm 213.

Figure 7:
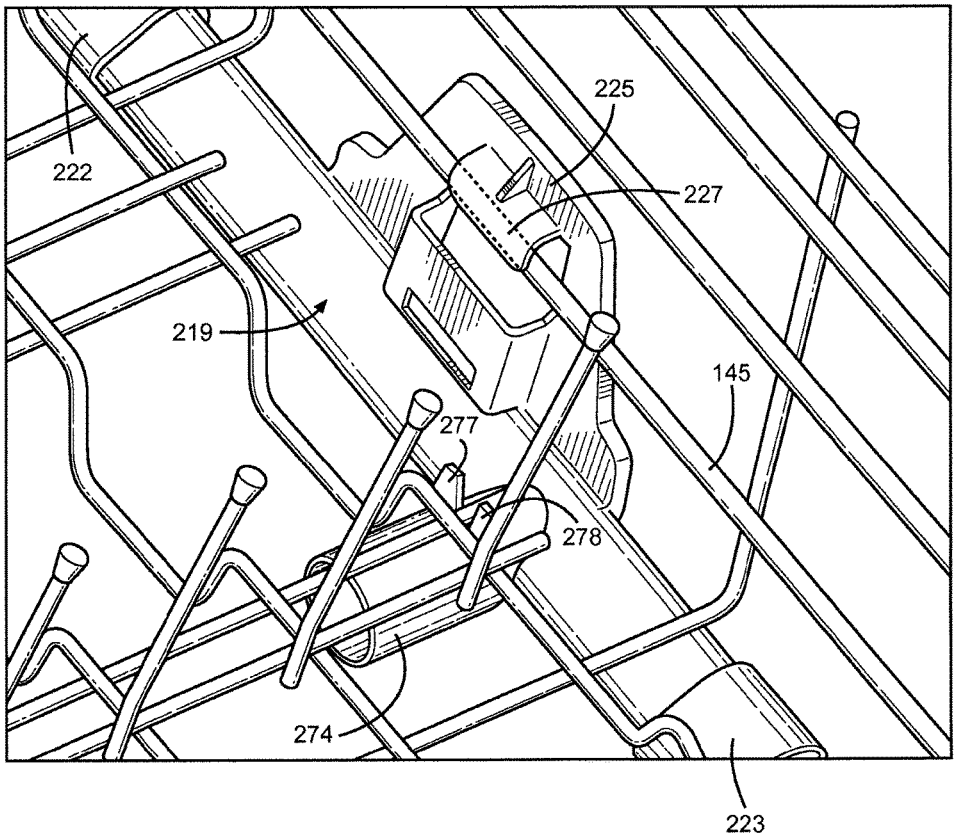
FIG. 7 illustrates a preferred mounting of a bifurcated spray arm portion of the multiple spray arms of FIG. 4 to a front portion of the rack.

In connection with describing the mounting of first upper spray arm 202 and second upper spray arm 213 to upper rack 16, reference will initially be made to FIGS. 3, 4 and 6. As previously indicated, first upper spray arm 202 is arranged beneath upper rack 16 as clearly shown in FIG. 3. Mounting bracket 209 engages with wires (not labeled) of upper rack 16, with one wire extending between side wall portions 141 and 142 being received within slot 210 of mounting bracket 209, while additional portions of the same wire are received by support members 265 and 266 (see FIG. 3). In this manner, potential forward movement of first upper spray arm 202 and manifold 180 towards front wall portion 139 is prevented. Thereafter, first upper spray arm 202 and manifold 180 are swung such that additional wires of upper rack 16 clip into recessed regions 269 and 270 formed in body 182. At the same time, locating flange 211 extends along a wire of base 136. With this overall mounting arrangement, head 204 can support intermediate spray arm 48 for rotation. At the same time, flow tube 216 has an end extending about port 185, extends within concave portion 268 of mounting bracket 209 and is fluidly connected with T-connector 219. More specifically, as best shown in FIG. 7, T-connector 219 includes a tube connector 274 which receives flow tube 216. Projecting out from tube connector 274 is a pair of space projections 277 and 278 which extend about another wire (not labeled) of upper rack 16 as clearly shown in this figure.

To further mount second spray arm 213, hanger element 227 of mounting bracket 225 is hung over wire 145 of upper rack 16.

At this point, it should be readily understood that it is simply important that each of manifold 180, first upper spray arm 202 and second spray arm 213 be mounted to rack 16 for concurrent movement between the retracted and extended positions. Depending on the particular configuration of upper rack 16 and its construction, the actual mounting of these elements to upper rack 16 can greatly vary in accordance with the invention. In any case, when upper rack 16 is in the retracted position, it should be recognized that port extensions 161 and 162 extend through respective openings 197 in cover member 195, as well as through respective flapper valves 190 in flapper valve member 189 in order to provide flow communication from first and second tubes 118 and 122 into manifold 180. Cover member 195 is provided with upper and lower sets of openings 197 in the manner corresponding to flapper valve member 189 due to the ability of upper rack 16 to be vertically adjusted through adjustment mechanism 17. Therefore, at any given time, port extensions 161 and 162 will either be received in the upper pair of openings 197 or the lower pair of openings 197. In either case, whether the upper rack 16 is in the raised or lowered position, fluid flowing from port extensions 161 or 162 will be directed into a respective side of manifold 180 due to the presence of internal divider 252. That is, as can best be understood by reviewing FIGS. 4 and 6, any washing fluid flowing through port extension 161 will be exposed to port 186 of manifold 180 and therefore will be delivered to first upper spray arm 202 and, correspondingly, intermediate spray arm 48. On the other hand, fluid flowing through port extension 162 will be delivered on the other side of internal divider 252 of manifold 180 and will be exposed to port 185, thereby leading to second spray arm 213. In addition to providing washing fluid to first upper spray arm 202, first tube 118 is also fluidly connected to upright tube extension 132 as perhaps best shown in FIG. 5. Therefore, a portion of fluid flowing through first tube 118 will be directed to first upper spray arm 202 so long as upper rack 16 is in the retracted position whereby manifold 180 is interengaged with coupling 158, while some of the flow through first tube 118 also bypasses tube extension 161 and flows into upright tube extension 132, followed by horizontal tube extension 133 and then to upper spray arm 49. In order to ensure proper registration between manifold 180 and coupling 158, ears 168 and 169 of coupling 158 extend within lobes 256 and 257 or lobes 258 and 259 depending on the vertical height of upper rack 16 and, in fact, preferably loosely engage onto manifold 180. In this manner, the force of washing fluid flowing through either of port extensions 161 and 162 cannot shift upper rack 16 away from coupling 158.

Figure 8:
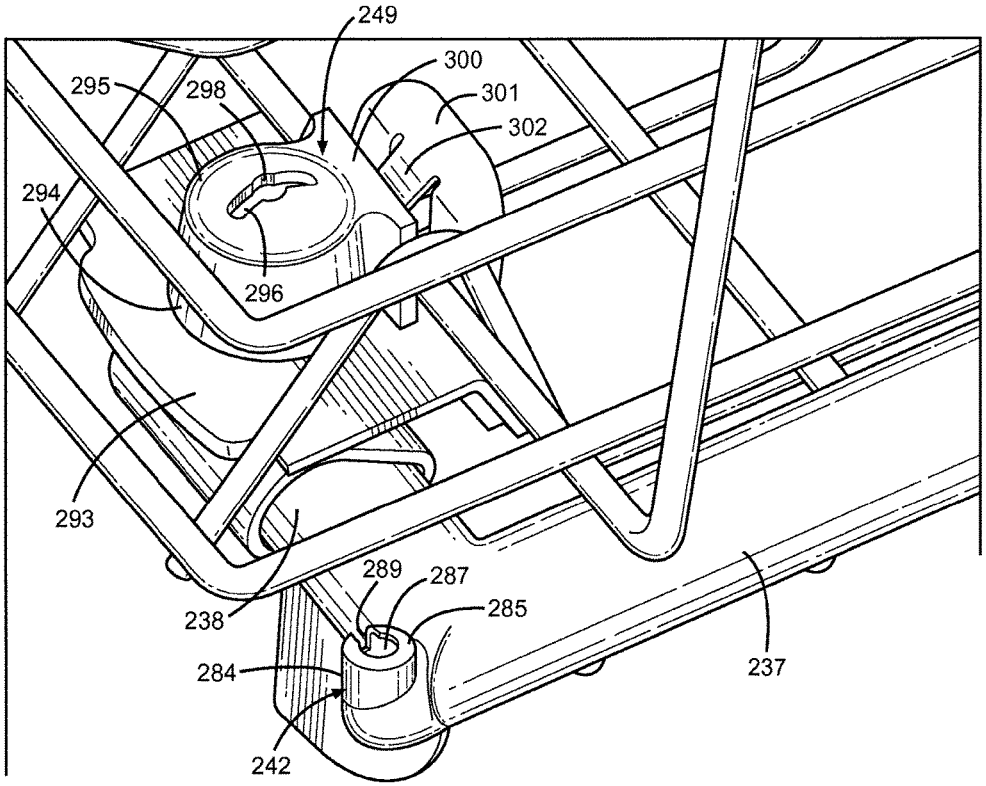
FIG. 8 depicts a corner spray arrangement of the bifurcated spray arm portion.

Reference will now be made to FIG. 8 in describing a preferred construction, mounting and operation of exterior corner nozzle 242 and interior corner nozzle 249. With the particular mounting arrangement associated with T-connector 219 of second spray arm 213, first leg 237 of each angled flow tube 235 is basically positioned outside or at the forwardmost kitchenware support region of upper rack 16. With the arrangement of first leg 237 and second leg 238, as well as the corner positioning of exterior corner nozzle 242, exterior corner nozzle 242 is advantageously positioned to enable washing fluid to be sprayed onto the outside surfaces of objects placed in the corners of upper rack 16. As illustrated in FIG. 8, each exterior corner nozzle 242 includes an upstanding portion 284 that leads to a top portion 285. Each top portion 285 is provided with an opening 287 from which extends a side slit 289. At this point, it should be recognized that, since upper rack 16 is generally rectangular in configuration and intermediate spray arm 48 rotates in a circular fashion, kitchenware placed in the corners of upper rack 16 are more likely to have a lower amount of washing fluid directed thereon during an overall washing operation. With the inclusion of second spray arm 213, washing fluid can be strategically directed to these corner portions of upper rack 16 in order to assure an adequate supply of washing fluid being sprayed upon kitchenware at these locations. Based on the location of exterior corner nozzle 242, washing fluid sprayed by exterior corner nozzle 242 is preferably directed inward at kitchenware on upper rack 16 and, assuming that certain kitchenware is provided in the associated corner, an outer surface of the kitchenware will be directly sprayed. Exterior corner nozzle 242 actually acts in conjunction with interior corner nozzle 249 to ensure an adequate spray in these regions. As shown, interior corner nozzle 249 preferably has associated therewith a base 293 from which projects a cap member 294. Cap member 294 has a top portion 295 provided with a slot 296 having an enlarged central open portion 298. Extending from cap member 294 is a support wall 300 and extending from base 293, at a position spaced from support wall 300, is a leg 301 from which is formed a flexible flange 302. As clearly shown in this figure, a wire of upper rack 16 is received between support wall 300 and spaced leg 301 and is snapped beneath flexible flange 302 in order to further support interior corner nozzle 249 directly from upper rack 16.

With this construction, washing fluid flowing into flow tube 216 will be bifurcated at T-connector 219, leading to both frontal exterior corner nozzles 242 and interior corner nozzles 249. Although shown only along frontal wall portion 139 of upper rack 16, it should be understood that second spray arm 213 could also extend to other corner portions of upper rack 16. For this purpose, FIG. 3 shows in phantom a potential side extension tube at 310. FIG. 3 also particularly illustrates how a certain piece of kitchenware can be advantageously cleaned through the use of exterior corner nozzle 242 and interior corner nozzle 249. As illustrated, a drinking glass or other container 315 is inverted over an interior corner nozzle 249. During particular portions of a washing operation when washing fluid is directed into second tube 122 and second spray arm 213 so as to reach exterior corner nozzles 242 and interior corner nozzles 249, the washing fluid will be sprayed directly within glass 315 so as to hit an interior annular surface 317 of glass 315 from interior corner nozzle 249. Simultaneously, the outermost exterior surface 320 of glass 315 will be directly sprayed by exterior corner nozzle 242. Therefore, instead of relying upon external surface 320 of glass 315 being washed by fluid which hits portions of tub 5 and are deflected onto exterior surface 320, exterior corner nozzle 242 will directly wash these surface portions. Of course, the particular spray arrangements and pattern can be readily adjusted by reconfiguring the slots and/or openings associated with exterior corner nozzle 242 and interior corner nozzle 249. As shown, it is preferred to establish a fan spray pattern with each of exterior and interior corner nozzles 242 and 249. In addition, further nozzles can be provided along first leg 237 to provide additional spraying patterns from exterior locations and, again, the flow path can be extended through the use of side extensions 310. In order to enhance the fluid spray pressure and spray efficiencies, it is preferred in accordance with the present invention to time the flow of washing fluid through first and second tubes 118 and 122 such that spray arms 48 and 49 will be provided with washing fluid from first tube 118 during certain periods of the washing operation and, at different times of the overall washing operation, the fluid supply to first tube 118 will be cut off and instead fluid will flow through second tube 122 so as to reach second spray arm 213. Again, variations in the spray pattern and timing can be easily controlled through suitable valving, such as through the use of diverter valve unit 126. Overall, providing the multi-tube fluid supply, mounting of manifold 180 to move with rack 16, providing both first upper spray arm 202 and second spray arm 213 on rack 16 and/or arranging both interior and exterior nozzles in corners of the rack provides for a more efficient and synergistic washing result in connection with cleaning a wide range of dishware placed upon rack 16 during a washing operation.

Although described with reference to preferred embodiments of the invention, it should be readily understood that various changes and/or modifications can be made to the invention without departing from the spirit thereof. For instance, although shown and described with reference to a dishwasher having a tub, shiftable racks and a pivoting door, the invention is applicable to other known dishwasher configurations, including drawer-type dishwashers. In addition, although the interior nozzle is designed to be clipped to a base of the upper rack in the disclosed embodiment, other mounting arrangements could readily be employed. For instance, interior nozzle could be secured to a side of the rack. Furthermore, although the spray system is explained with reference to its use on an upper rack, the system could be equally applied to a lower rack or both upper and lower racks. In the latter case, the second tube would supply nozzles on multiple levels. In general, the invention is only intended to be limited by the scope of the following claims.

What is claimed is:

1. A dishwasher comprising:

a tub defining a washing chamber adapted to receive and cleanse soiled kitchenware with recirculating washing fluid during a washing operation;

a rack mounted in the tub for supporting kitchenware during the washing operation, said rack including a base, a front wall portion, a rear wall portion, side wall portions, and multiple corner portions including front corner portions at intersections of the front and side wall portions; and a spray arm configured to direct washing fluid during a washing operation upon kitchenware placed in the rack, said spray arm being bifurcated to establish sub-arm sections, with each of the sub-arm sections extending to a respective one of the corner portions and including multiple nozzles at the respective one of the corner portions, wherein the multiple nozzles include an exterior corner nozzle located outside the rack.

2. The dishwasher according to claim 1, wherein the multiple nozzles further include an interior corner nozzle located within the rack.

3. The dishwasher according to claim 2, wherein the interior corner nozzle extends above the base of the rack.

4. The dishwasher according to claim 3, wherein the interior corner nozzle is directly clipped to the rack.

5. The dishwasher according to claim 3, wherein each of the sub-arm sections including a leg extending rearward toward the rear wall portion and being provided with a respective said interior corner nozzle.

6. The dishwasher according to claim 2, wherein each of the interior and exterior nozzles is configured to direct washing fluid upward upon kitchenware placed in a respective one of the front corner portions of the rack during the washing operation.

7. The dishwasher according to claim 2, wherein the interior corner nozzle constitutes a fan spray nozzle.

8. The dishwasher according to claim 2, wherein the rack is movable relative to the tub between a retracted, operational position within the washing chamber to an extended, access position at least partially out of the washing chamber, said spray arm being mounted for concurrent movement with the rack between the extended and retracted positions.

9. The dishwasher according to claim 1, wherein the exterior corner nozzle is located below a level of the rack.

10. A dishwasher comprising:

a tub defining a washing chamber adapted to receive and cleanse soiled kitchenware with recirculating washing fluid during a washing operation;

a rack mounted in the tub for supporting kitchenware during the washing operation, said rack including a base, a front wall portion, a rear wall portion, side wall portions, and multiple corner portions including front corner portions at intersections of the front and side wall portions; and a spray arm configured to direct washing fluid during a washing operation upon kitchenware placed in the rack, said spray arm being bifurcated to establish sub-arm sections, with each of the sub-arm sections extending to a respective one of the corner portions and including multiple nozzles at the respective one of the corner portions, wherein the spray arm is mounted to and bifurcated at a central section of the front wall portion of the rack.

11. The dishwasher according to claim 10, wherein the spray arm includes a T-connector, with the spray arm being bifurcated at the front wall portion through the T-connector.

12. The dishwasher according to claim 10, wherein the spray arm extends beyond the front wall portion of the rack.

13. A dishwasher comprising:

a tub defining a washing chamber adapted to receive and cleanse soiled kitchenware with recirculating washing fluid during a washing operation;

a rack mounted in the tub for supporting kitchenware during the washing operation, said rack including a base, a front wall portion, a rear wall portion, side wall portions, and multiple corner portions including front corner portions at intersections of the front wall portion with the side wall portions and rear corner portions at intersections of the rear wall portion and the side wall portions, wherein the rack is movable relative to the tub between a retracted, operational position within the washing chamber to an extended, access position at least partially out of the washing chamber; and a spray arm mounted for concurrent movement with the rack between the extended and retracted positions and being configured to direct washing fluid during a washing operation upon kitchenware placed in the rack, said spray arm including:

a main supply tube extending from the rear wall portion, substantially intermediate the side wall portions, toward the front wall portion;

sub-arm sections leading from the main supply tube along the front wall portion toward the front corner portions and then extending rearward toward the rear corner portions; and corner nozzles provided at the front corner portions and configured to direct washing fluid upon kitchenware placed in the front corner portions of the rack during the washing operation.

14. The dishwasher according to claim 13, wherein the corner nozzles include both an interior corner nozzle located within the rack and an exterior corner nozzle located outside the rack.

15. The dishwasher according to claim 14, wherein the exterior corner nozzle is located below a level of the rack.

16. The dishwasher according to claim 15, wherein the interior corner nozzle extends above the base of the rack.

17. The dishwasher according to claim 14, wherein each of the sub-arm sections including a leg extending rearward toward the rear wall portion and being provided with a respective said interior corner nozzle.

18. The dishwasher according to claim 14, wherein each of the interior and exterior nozzles is configured to direct washing fluid upward upon kitchenware placed in a respective one of the front corner portions of the rack during the washing operation.

19. The dishwasher according to claim 13, wherein the spray arm is mounted to and bifurcated at the front wall portion of the rack.

20. The dishwasher according to claim 13, wherein the spray arm extends beyond the front wall portion of the rack.

* * * * *